US008939546B2

(12) United States Patent
Veis

(10) Patent No.: US 8,939,546 B2
(45) Date of Patent: Jan. 27, 2015

(54) COORDINATED PRINTHEAD OPERATION

(75) Inventor: Alex Veis, Kadima (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 241 days.

(21) Appl. No.: 13/547,879

(22) Filed: Jul. 12, 2012

(65) Prior Publication Data

US 2014/0015881 A1 Jan. 16, 2014

(51) Int. Cl.
*B41J 23/00* (2006.01)

(52) U.S. Cl.
USPC ..... 347/37; 347/12; 347/39; 347/41; 347/42

(58) Field of Classification Search
CPC .... B41J 2/16585; B41J 19/142; B41J 19/145; B41J 19/147; B41J 25/006
USPC ..... 347/12, 37, 39, 41, 42
See application file for complete search history.

(56) References Cited

U.S. PATENT DOCUMENTS

| | | | |
|---|---|---|---|
| 6,095,637 | A | 8/2000 | Hirabayashi et al. |
| 6,250,739 | B1 | 6/2001 | Serra |
| 6,450,614 | B1 | 9/2002 | Scheffelin et al. |
| 8,167,404 | B2 | 5/2012 | Mantell et al. |
| 2010/0165031 | A1 | 7/2010 | Laaspere et al. |

OTHER PUBLICATIONS

Bruijnen et al., "Active printhead alignment for Wide Format Printing Systems", Proceedings of the 2007 American Control Conference, Jul. 11-13, 2007, pp. 1520-1525.

*Primary Examiner* — Justin Seo
(74) *Attorney, Agent, or Firm* — Pearl Cohen Zedek Latzer LLP; Mark Cohen

(57) ABSTRACT

A method includes moving an assembly of printheads with a bidirectional lateral motion. A direction of the lateral motion is substantially perpendicular to, and the lateral motion is concurrent with, a longitudinal motion of a substrate relative to the printhead assembly. Nozzles of the printheads are arranged in two rows that are oriented substantially parallel to the direction of the lateral motion. The longitudinal motion and the lateral motion are coordinated such that a nozzle in one of the rows and a nozzle in the other of the rows trace a common path on the substrate.

20 Claims, 7 Drawing Sheets

COORDINATED PRINTHEAD OPERATION

BACKGROUND

An inkjet printer includes a printhead with a plurality of nozzles through which ink is ejected. Neighboring nozzles on the printhead are separated from one another by a distance that is referred to as the pitch of the printhead. Drops of ink that are ejected from the nozzles may be deposited on a substrate (e.g. paper). A distance between neighboring drops that are deposited on the substrate determines the resolution of the printer (e.g. as measured in units of dots per inch).

During the course of printing, the substrate may be moved longitudinally past a printhead bridge to which one or more printheads are mounted so as to print on various regions of the substrate. In order to enable a resolution that is greater than the resolution that is determined by the pitch of the printhead (e.g. nozzles per inch), the printhead may be moved laterally during the course of printing. Lateral movement of the printhead may enable a nozzle of the printhead to deposit a drop of ink at a lateral position on the substrate. Subsequently, after the nozzle is moved through a distance that is shorter than the printhead pitch, the same nozzle may deposit another drop at another lateral position on the substrate. Thus, the lateral distance between the two drops may be less than the pitch of the printhead.

In some inkjet printers, e.g. in many inkjet printers that are designed for home or office use, longitudinal motion of the substrate past the bridge is halted during lateral motion of the printhead along the bridge. In other high-speed inkjet printers, such as inkjet printers that are designed to print on large substrates, the printhead may be moved along the bridge concurrently with the longitudinal motion of the substrate past the bridge.

DETAILED DESCRIPTION

Figure 1:
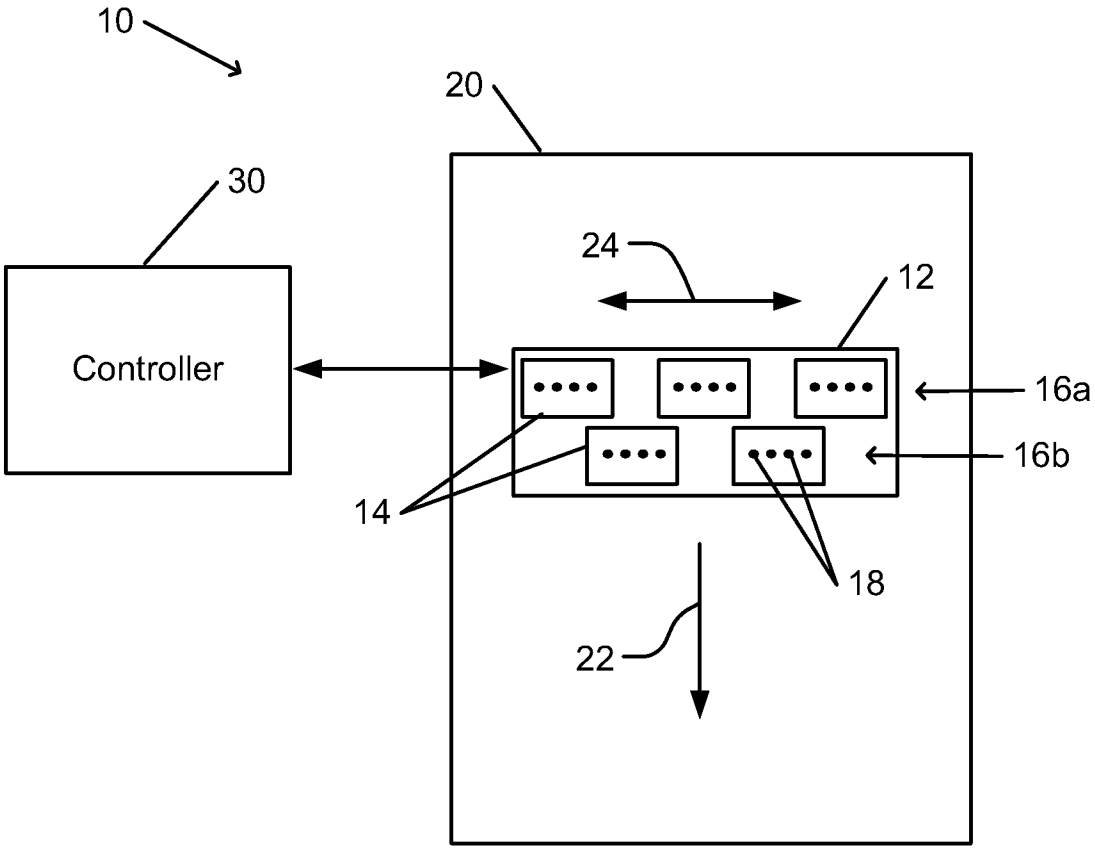
FIG. 1 is a schematic illustration of a printer system for application of an example of coordinated printhead operation.

In accordance with an example of coordinated operation of printheads, an inkjet printer includes a printhead assembly that includes a plurality of printheads. The printheads of the printhead assembly are arranged in a plurality of rows. The various printheads of the printhead assembly are configured to be moved in a coordinated fashion during the course of printing on a substrate. For example, the printheads of the printhead assembly may be mounted together on a common bridge.

During printing, the printer causes relative longitudinal motion between the substrate and the printhead assembly. The longitudinal motion may enable the printhead assembly to deposit ink (or another substance, e.g. paint or another fluid, all of which are herein referred to as ink) along an entire length of a printable area of the substrate. For example, the substrate may be conveyed longitudinally past the printhead assembly during printing. The substrate may be mounted on a drum that rotates past the printhead assembly during printing. As another example, the substrate may be placed on a bed, platform, or table that is moved past the printhead assembly during printing. In another example, the printhead assembly (e.g. a bridge on which the printhead is mounted) may be longitudinally translated past a fixed substrate during printing.

Each printhead includes a face that contains a substantially regular array of nozzles through which ink (or another fluid) may be ejected during printing. Various operational considerations may limit the number of nozzles that may be included in a single printhead. Therefore, in order that the printhead assembly include a desired number of nozzles (e.g. a row of nozzles whose length is sufficient to cover the width of a printable area of a substrate during the course of printing), the printhead assembly includes a plurality of printheads arranged generally along a lateral direction that may be perpendicular to (or at another angle to) the longitudinal direction of relative motion between the printhead assembly and the substrate.

A lateral distance between neighboring nozzles of a single printhead is designated the pitch of the printhead. Printhead design or other considerations may dictate that the area of the face of the printhead that is covered by the nozzles be smaller than the physical outer dimensions of the printhead (e.g. of a casing of the printhead). Thus, were the printheads of the printhead assembly to be arranged in a single row, the physical dimensions of the printhead could force the lateral distance between neighboring nozzles on adjacent printheads to be unacceptably large. (The printheads of the printhead assembly are assumed to be substantially identical to one another.) Therefore, the printheads of the printhead assembly are arranged in a staggered manner within a plurality of rows. Thus, a printhead in one of the rows may be mounted in the printhead assembly such that the outer casing of that printhead partially overlaps, in the lateral direction, the outer casing of a printhead in another of the rows.

Concurrently with the longitudinal relative motion between the substrate and the printhead assembly, the printhead assembly may be laterally translated across the substrate. For example, the printhead assembly may be moved parallel to a length of a bridge on which the printhead assembly is mounted (referred to as bridge shift). The lateral motion may be substantially perpendicular to (or at another oblique angle to) the longitudinal motion.

The lateral motion may enable a nozzle to deposit ink on points of the substrate (e.g. at lateral positions between the lateral positions of the nozzles) where no ink would be deposited in the absence of lateral motion. Thus, the lateral motion may enable increasing the density of printed dots (print resolution) to a density that is greater than what would be possible in the absence of the lateral motion. For example, in a printer system with a drum-mounted substrate, a resolution of the image (e.g. dots per inch) may be an integer multiple of the nozzle density (inverse of the nozzle pitch, e.g. in units of nozzles per inch), e.g. four. In this case, if the nozzle pitch is $1/150$ inch (nozzle density of 150 nozzles per inch), the spacing between dots (print resolution) may be reduced to $1/600$ inch (dot density of 600 dots per inch). In this example, during the course of a single rotation of the drum, the lateral motion may move the printhead assembly by a quarter of the nozzle pitch. Thus, during each subsequent rotation of the drum with the same substrate, dots may be printed at points that are between the dots that were printed in the previous rotations. (In practice, considerations in addition to resolution may dictate a lateral motion that is greater than minimal motion distance that is dictated by resolution considerations alone. For example, in order to minimize the effects of a failed nozzle in the above example, the lateral motion may be greater than one quarter of the nozzle pitch so as to ensure that adjacent dots are not deposited by single nozzle.)

As a result of the combination of the concurrent longitudinal relative motion and lateral motion of the printhead assembly, each nozzle traces a path that is not parallel to either the longitudinal direction or to the lateral motion. For example, the nozzle may trace an oblique line or curve over the surface of a substrate. If both the longitudinal relative motion and the lateral motion are constant, the nozzle traces a straight line that is diagonal to the longitudinal direction and the lateral direction. In the case that the substrate is mounted on a drum, each nozzle traces a helical path around the surface of the drum. Thus, in the case of a drum-mounted substrate, the concurrent longitudinal and lateral motions may be referred to as spiral motion.

At a given point during printing, nozzles in one of the rows are positioned opposite a line at a given longitudinal position on the substrate. Thus, the nozzles are positioned to deposit drops of ink at various lateral positions (with respect to the position of the printhead array at the time that the drops are deposited) along that line. At a subsequent time, the line may be brought opposite nozzles in another of the rows of the printhead array. Due to the concurrent longitudinal and lateral motions, and due to the longitudinal spacing between the rows of nozzles, the lateral positions (with respect to the current position of the printhead array) of any deposited drops along the line are laterally shifted (from their positions with respect to the position of the printhead array at the time of depositing). Thus, in order to ensure that the lateral spacing between dots that are deposited by laterally adjacent nozzles is uniform within a deposited line of drops, whether or not the nozzles are in the same row, depositing of the drops may be coordinated with the longitudinal and lateral motions.

In a relatively low-speed printer system, the lateral motion could be limited to single direction (e.g. the bridge would be returned to a starting position prior to printing on a substrate) and the speed of the lateral motion relative to the longitudinal motion would be approximately constant. In such a low-speed printer system, placement of the printheads in which the ratio between the velocities of the longitudinal and lateral motions could be selected (e.g. designed) so as to ensure a uniform density of deposited dots. In such a low-speed system, further coordination of depositing ink drops with the longitudinal and lateral motion may not be applied.

A high-speed printer system may be designed to produce a large volume of a printed product in a short amount of time. For example, in a high-speed process, a continuous substrate (e.g. a continuous sheet of paper that is supplied from a roll) may be fed to a drum or other system that continuously conveys the substrate past a printing bridge. The system may include a cutting device for separating a printed product, or a section of the substrate to be made into a printed product, from the continuous substrate (e.g. before or after printing).

In a high-speed printer system or similarly configured printing system, the lateral motion may be bidirectional. For example, during the course of printing on one substrate (or during the course of one phase of printing on a substrate) a printing array may be moved laterally from left to right. (In the case of a substrate that is mounted on a rotating drum, printing may take place during several rotations of the drum.) During the course of printing on another substrate (or during the course of another phase of printing on a substrate) the printing array may be moved laterally from right to left. An example of coordinated printhead operation may be applied in such a high-speed printer system (or another printer system) so as to print an image with uniform resolution. For example, the direction of the lateral motion may alternate between opposite directions each time the substrate is replaced with a new substrate.

In accordance with an example of application of coordinated printhead operation, a plurality of (e.g. two) nozzles in a similar plurality of (e.g. two) rows of a printhead assembly are configured to trace a common path (e.g. substantially coinciding or overlapping paths) on a substrate. Printing by those nozzles is coordinated such that only one of the plurality of nozzles deposits ink on a given segment of the common path. For example, one of the nozzles may deposit ink on one segment of the common path, while another deposits ink on a different segment of the common path.

A printer system may be configured for application of an example of coordinated printhead operation.

FIG. 1 is a schematic illustration of a printer system for application of an example of coordinated printhead operation.

Printer system 10 includes a printhead array 12 for printing on substrate 20. Printhead array 12 includes a plurality of printheads 14 arranged in two rows 16*a* and 16*b*. Each printhead 14 includes an array of nozzles 18. A drop of ink (e.g. from an ink reservoir that is not shown) may be expelled from a nozzle 18 so as to be deposited on substrate 20.

During printing, printhead 14 is moved relative to substrate 20. Arrow 22 represents a direction of longitudinal motion (henceforth longitudinal motion 22) of substrate 20 relative to printhead array 12. For example, substrate 20 may be mounted on or supported by a motorized drum that is rotated so as to move substrate 20 past printhead array 12 (which may, e.g., be mounted on a longitudinally stationary printing bridge) in the direction of longitudinal motion 22. Thus, a line of substrate 20 that is oriented substantially perpendicular to longitudinal motion 22 may be brought opposite row 16*a* prior to being brought opposite row 16*b*.

Double-headed arrow 24 represents opposing directions of bidirectional lateral motion (henceforth lateral motion 24) of printhead array 12 relative to substrate 20. For example, printhead array 12 may be mounted on a motorized printing bridge along which printhead array 12 may be moved alternately in each of the opposing directions indicated for lateral motion 24. Lateral motion 24 may be substantially perpendicular to longitudinal motion 22, or may be oriented at another oblique angle to longitudinal motion 22. For example, when printing on one substrate 20 (e.g. during several rotations of drum on which substrate 20 is mounted) lateral motion 24 may be along on of the indicated opposing motions. During printing on another substrate 20, lateral motion 24 may be in a direction opposite to the direction of lateral motion 24 when printing on the previous substrate 20.

Moving printhead array 12 with a continuous lateral motion 24 in a single direction during printing on one substrate 20, alternating with reversed continuous lateral motion 24 during printing on a subsequently replaced substrate 20, may enable high-speed printing on a series of substrates 20. For example, such control of lateral motion 24 may enable reduction of periods of time during which printhead assembly 12 is moved without printing.

A mechanism (e.g. a drum motor or drive mechanism) for effecting longitudinal motion 22 of substrate 20 (or of printhead array 12 with respect to substrate 20), a mechanism (e.g. an electric motor) for effecting lateral motion 24 of printhead array 12 (or of substrate 20 with respect to printhead array 12), operation of ink depositing by nozzles 18, as well as any other operation of printer system 10 (e.g. a substrate cutting device, substrate loading or unloading, ink pumping device), may be controlled by controller 30.

Figure 2:
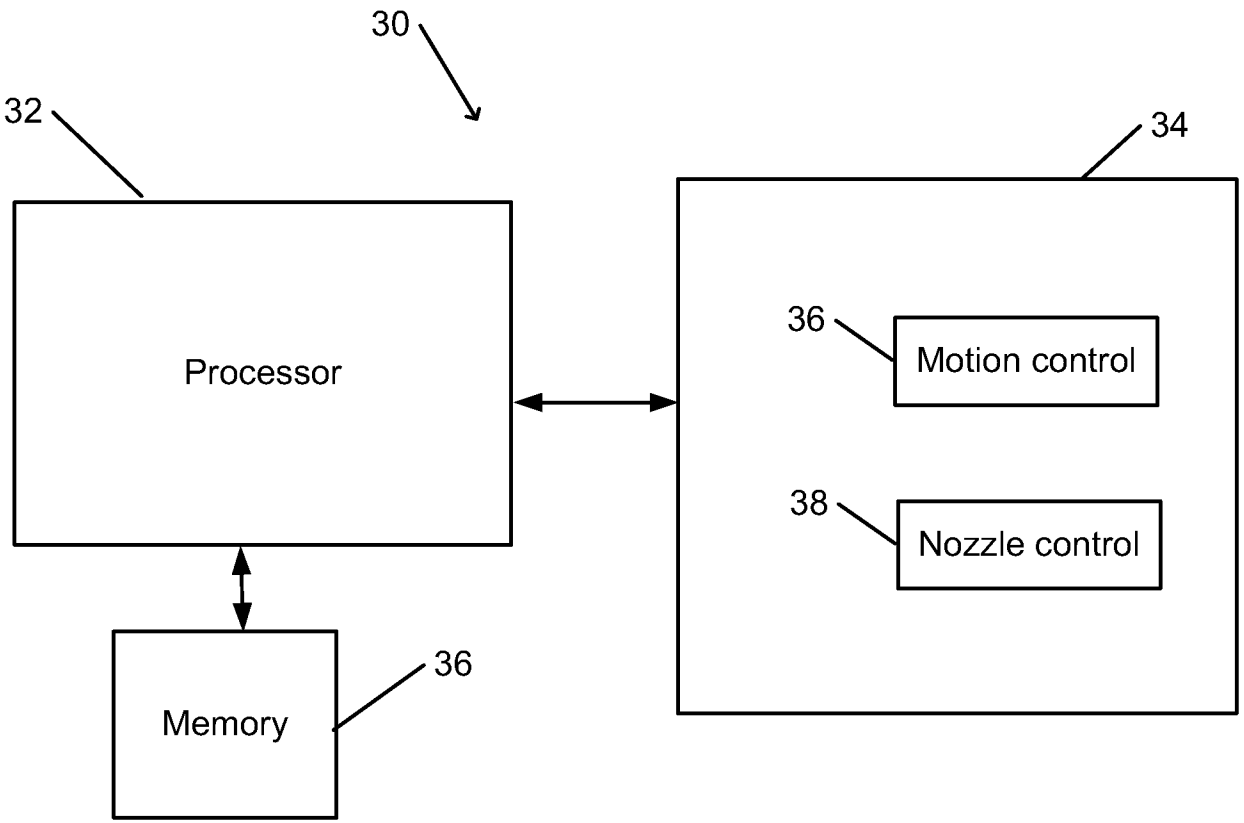
FIG. 2 is a schematic illustration of a controller of the printer system illustrated in FIG. 1.

FIG. 2 is a schematic illustration of a controller of the printer system illustrated in FIG. 1. Controller 30 includes a processor 32. For example, processor 32 may include one or more processing units, e.g. of one or more computers. One or more components of processor 32 may be incorporated into a printer or other printing device, or may be incorporated in a computer or server that communicates with a printer. Processor 32 may be configured to operate in accordance with programmed instructions stored in memory 36. Processor 32 may be capable of executing an application for coordinated printhead operation. Processor 32 may be configured to obtain data form printer system 10 (FIG. 1) or to control operation of one or more components of printer system 10. For example, obtained data may include locations on a substrate were dots of ink had be previously deposited. Obtained data may include a current location of a nozzle relative to the substrate.

Processor 32 may communicate with memory 36. Memory 36 may include one or more volatile or nonvolatile memory devices. Memory 36 may be utilized to store, for example, programmed instructions for operation of processor 32, data or parameters for use by processor 32 during operation, or results of operation of processor 32. Memory 36 may be utilized to store a representation of an image (used herein to include characters or text) that is to be printed on a substrate.

Processor 32 may communicate with data storage device 34. Data storage device 34 may include one or more fixed or removable nonvolatile data storage devices. For example, data storage device 34 may include a computer readable medium for storing program instructions for operation of processor 32. In this example, the programmed instructions may take the form of motion control module 36 for monitoring and controlling motion that is associated with a printhead, or nozzle control module 38 for controlling expulsion of ink from a nozzle of a printhead. It is noted that data storage device 34 may be remote from processor 32. In such cases data storage device 34 may be a storage device of a remote server storing motion control module 36 or nozzle control module 38 in the form of an installation package or packages that can be downloaded and installed for execution by processor 32. Data storage device 34 may be utilized to store data or parameters for use by processor 32 during operation, or results of operation of processor 32. Data storage device 34 may be utilized to store a representation of an image that is to be printed on a substrate.

Figure 3:
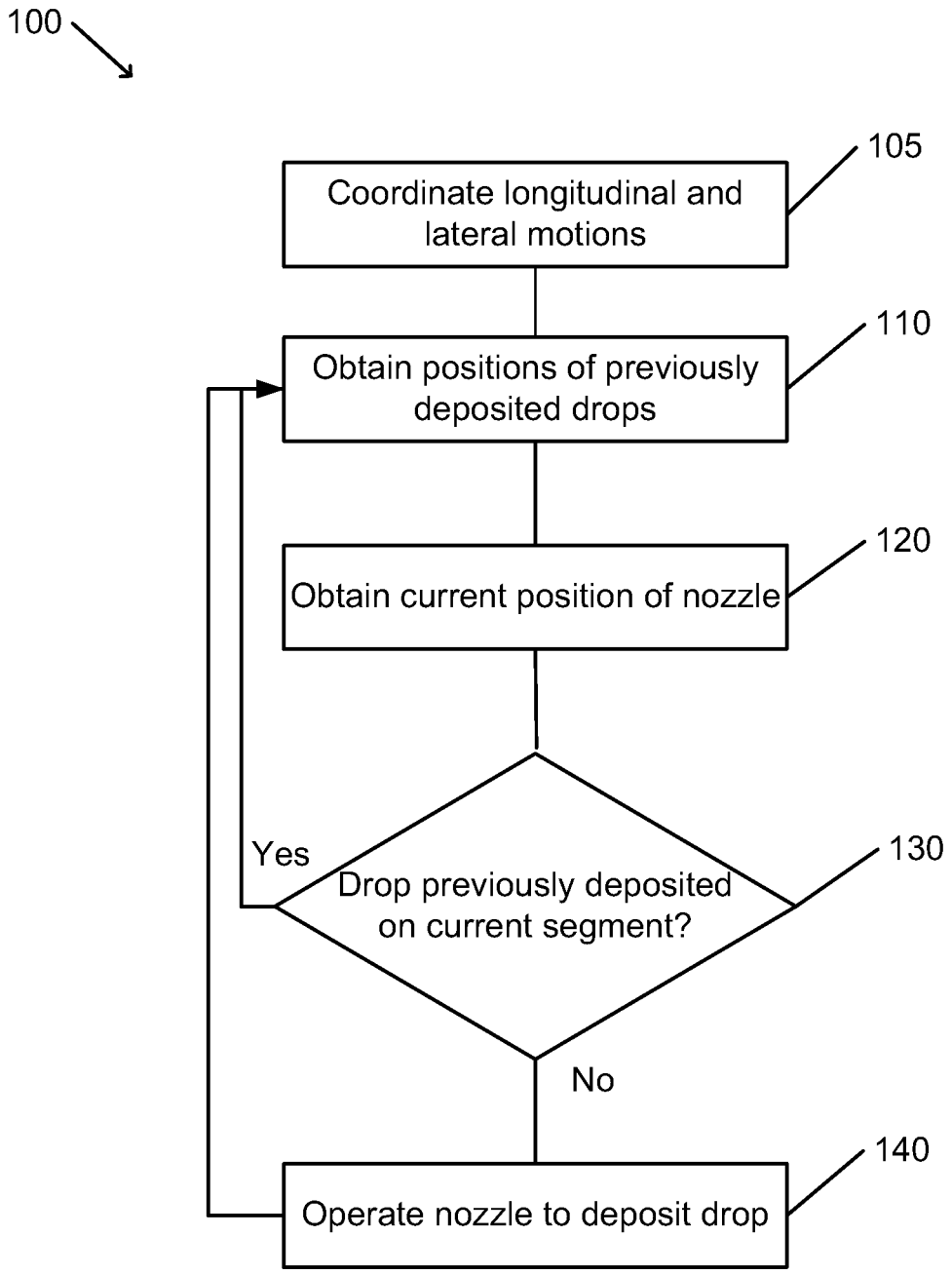
FIG. 3 is a flowchart depicting an example of a method for coordinated printhead operation.

In operation, processor 32 may execute a method for coordinated printhead operation. FIG. 3 is a flowchart depicting a method for coordinated printhead operation. In discussion of FIG. 3, reference is also made to components illustrated in FIGS. 1 and 2.

In the Example of FIG. 3, printhead operation method 100 may be executed by a processor 32 or a controller 30 of a printer system that is configured for coordinated printhead operation. Printhead operation method 100 may be executed upon a request or command that is issued by a user (e.g. to print a document), or automatically issued by another application. Printhead operation method 100 may be executed separately with respect to each printhead assembly 12 of a printer system (e.g. in a system where a separate printhead assembly is provided for each color of ink). Printhead operation method 100 may be executed separately with respect to each substrate 20 on which ink is to be deposited.

It should be understood with respect to the flowchart that the division of the illustrated method into discrete operations represented by blocks of the flowchart has been selected for convenience and clarity only. Alternative division of the illustrated method into discrete operations is possible with equivalent results. Such alternative division of the illustrated method into discrete operations should be understood as representing other examples of the illustrated method.

Similarly, it should be understood that, unless indicated otherwise, the illustrated order of execution of the operations represented by blocks of the flowchart has been selected for convenience and clarity only. Operations of the illustrated method may be executed in an alternative order, or concurrently, with equivalent results. Such reordering of operations of the illustrated method should be understood as representing other examples of the illustrated method.

Printhead operation method 100 includes controlling a longitudinal motion 22 (e.g. of substrate 20 relative to printhead assembly 12) and a lateral motion 24 (e.g. of printhead assembly 12 relative to substrate 20) such that the motions are coordinated (block 105). As a result of the coordinated motion, a nozzle 18 in one of rows 16*a* and 16*b* traces a common path 48

Printhead operation method 100 includes obtaining positions of any drops of ink that were previously deposited on a current substrate (block 110). For example, the positions of previously deposited drops may be derived from a representation of an image. The representation may be analyzed in light of a stored representation of geometry of a printhead assembly. In another example, a controller 30 may receive a signal that indicates a current position of a printhead assembly 12 relative to a substrate 20. Such a signal may be received from, e.g., an encoder of a mechanism for moving printhead assembly 12 or substrate 20.

As another example, a log may be stored (e.g. in memory 36 of FIG. 2) of positions of any drops of ink that were recently deposited on a current substrate. Such a log may be limited to those deposited drops of ink that were deposited sufficiently recently to be relevant to execution of printhead operation method 100. For example, previous depositing of a drop by a nozzle of a row of the printhead assembly may be considered relevant if a position of that drop may yet be expected to be brought opposite a nozzle in another row of the printhead assembly during a current pass of the printhead assembly over the substrate (e.g. during a current rotation of a drum). Positions of drops that are no longer relevant to execution of printhead operation method 100 may be deleted from the log. For example, a printhead assembly may include two rows of nozzles that are separated by a distance d. If a longitudinal velocity of a substrate relative to a printhead assembly is $v_{long}$, then a log may include positions of at least those drops of ink that had been previously deposited within a time $t=d/v_{long}$.

A current position of a current nozzle whose operation is to be controlled may be obtained (block 120). For example, a current position of the current nozzle may be calculated on the basis of a current position of a printhead assembly 12 relative to a substrate 20. Such a position may be calculated on the basis of a known motion of printhead assembly 12 relative to substrate 20, or on the basis of a position measurement (e.g. by an encoder of a mechanism for moving printhead assembly 12 or substrate 20).

The current position of the current nozzle relative to substrate 20 may be compared with the obtained positions of any previously deposited drops (block 130). For example, a current segment of a path traced by the current nozzle may be examined to determine whether another nozzle of another row of printhead assembly 12 traces the same path, and whether that nozzle had deposited a drop of ink in the current segment. In accordance with some embodiments of printhead operation method 100, the comparison may be limited to those nozzles that, in accordance with the geometry of printer system 10, are determined to trace a path that overlaps a path that is traced by another nozzle.

If a drop of ink had been previously deposited on the current segment, no ink is deposited by the current nozzle. Execution of printhead operation method 100 may continue for another nozzle of printhead assembly 12 (may be executed concurrently for all or some of a plurality of nozzles in a single row), or with respect to a subsequent position of the current nozzle (repeating the operations indicated by blocks 110 through 130).

If no drop of ink had been previously deposited (e.g. by any nozzle of the printhead assembly during a current pass over the current substrate) on the current segment, and if so indicated by a representation of an image being printed, the current nozzle may be operated to deposit ink at the current position on substrate 200. Execution of printhead operation method 100 may continue (or be executed concurrently) with respect to another nozzle of printhead assembly 12 or with respect to a subsequent position of the current nozzle (repeating the operations indicated by blocks 110 through 130).

In accordance with an example of a method for coordinated printhead operation, a computer program application stored in a computer-readable medium (e.g., register memory, processor cache, RAM, ROM, hard drive, flash memory, CD ROM, magnetic media, etc.) may include code or executable instructions that when executed may instruct or cause a controller or processor to perform methods discussed herein, such as an example of a method for coordinated printhead operation. The computer-readable medium may be a non-transitory computer-readable media including all forms and types of computer-readable media except for a transitory, propagating signal.

Coordinated printhead operation may be understood in connection application of coordinated printhead operation to an example of a printhead assembly.

Figure 4:
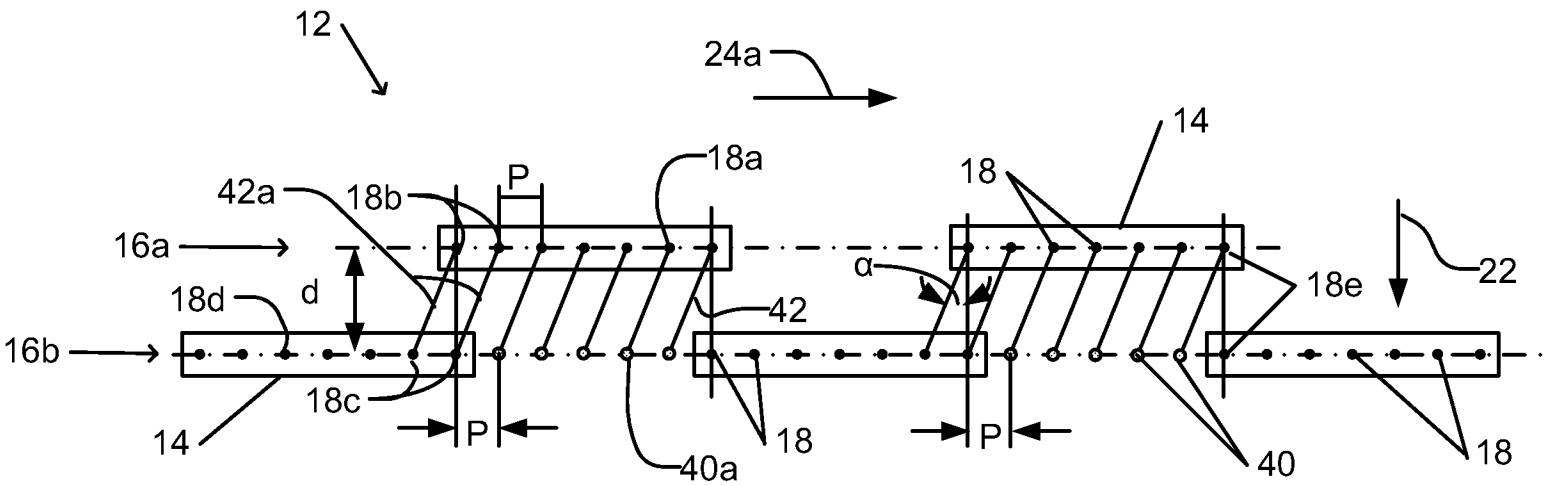
FIG. 4 schematically shows an example of application of coordinated printhead operation for rows of printheads with overlapping nozzles.

FIG. 4 schematically shows an example of application of coordinated printhead operation for rows of printheads with overlapping nozzles.

Printhead assembly 12 includes a plurality of printheads 14 whose nozzles 18 are arranged in two rows, row 16*a* and row 16*b*. In a single printhead 14 in either row 16*a* or row 16*b*, adjacent nozzles 18 are separated by nozzle separation distance P. Rows 16*a* and 16*b* are separated by distance d. A nozzle at or near each ends of each printhead 14 in one of rows 16*a* or 16*b* is arranged at the same lateral position as a nozzle at or near an end of a printhead 14 in the other of rows 16*a* or 16*b*. For example, nozzles 18*e* laterally overlap one another. (Two or more nozzles may be made to overlap.)

A substrate 20 (FIG. 1) moves with longitudinal motion 22, with speed $v_{long}$, past printhead assembly 12. (For simplicity, speed $v_{long}$ is assumed to be constant. However, an example of coordinated printhead operation may also be applied to a longitudinal motion whose speed varies in a known manner.) Thus, a laterally elongated region (e.g. a horizontal line in FIG. 4) of a substrate 20 first encounters nozzles 18 of row 16*a*, and afterward nozzles 18 of row 16*b*. When the region is opposite row 16*a*, a dot 40 may be deposited on substrate 20 by a nozzle 18 in row 16*a*. As a particular example, dot 40*a* may be deposited by nozzle 18*a*.

Printhead assembly 12 is concurrently moved with lateral motion 24*a* with a speed $v_{lat}$. (For simplicity, speed $v_{lat}$ is assumed to be constant. However, an example of coordinated printhead operation may also be applied to a lateral motion whose speed varies in a known manner.) Thus, when a dot 40 is moved to opposite 16*b*, dot 40 is moved laterally. In accordance with the example shown, lateral motion 24*a* is coordinated with longitudinal motion 22 such during the time that a dot 40 is longitudinally moved from row 16*a* to row 16*b*, that dot 40 is translated laterally through a distance equal to nozzle separation distance, or nozzle pitch, P. This may be expressed as $$P = \frac{d \cdot v_{lat}}{v_{long}}.$$

This ratio of the speeds of lateral motion 24*a* and longitudinal motion 22, together with the overlapping of nozzles such as nozzles 18*e*, may ensure that the spacing of neighboring deposited dots is equal to nozzle pitch P, whether the two dots were deposited by nozzles 18 in a single row, or by nozzles 18 in different rows. Neighboring deposited dots is used herein to refer to adjacent locations where two dots could be deposited by nozzles 18 on a line of substrate 20, whether or not dots of ink are actually deposited there. (Whether or not a dot is actually deposited at a particular location is dictated by details of an image to be printed.)

Each nozzle 18 traces over substrate 20 a path 42. In this example (with constant lateral motion 24*a* and constant longitudinal motion 22), each path 42 is in the form of a straight line forming an angle $\alpha$ with the direction of longitudinal motion 22, where $$\tan\alpha = \frac{v_{lat}}{v_{long}} = \frac{P}{d}.$$

For example, a dot (not shown, for the sake of clarity) that is printed by either of nozzles 18*b* in row 16*a* may be translated to the position of one of nozzles 18*c* in row 16*b*. Thus, the paths that are traced by corresponding nozzles 18*b* and nozzles 18*c* coincide or overlap in the form of common path 42*a*. In accordance with an example of coordinated printhead operation, e.g. in order to prevent depositing of excessive ink on substrate 20, a nozzle 18*c* may be controlled so as not to deposit ink when opposite the dot that was deposited by the corresponding nozzle 18*b*. On the other hand, if nozzle 18*b* had not deposited a dot on substrate 20, the corresponding nozzle 18*c* may be controlled to do so (e.g. if warranted in accordance with a representation of an image to be printed).

Another nozzle 18, such as, for example, nozzle 18*a* of row 16*a* or nozzle 18*d* of row 16*b*, may not share a path with a nozzle in the other of row 16*a* or 16*b*. In accordance with an example of coordinated printhead operation, nozzle 18*a* and nozzle 18*d* may be operated without need to check for previously deposited dots.

Figure 5:
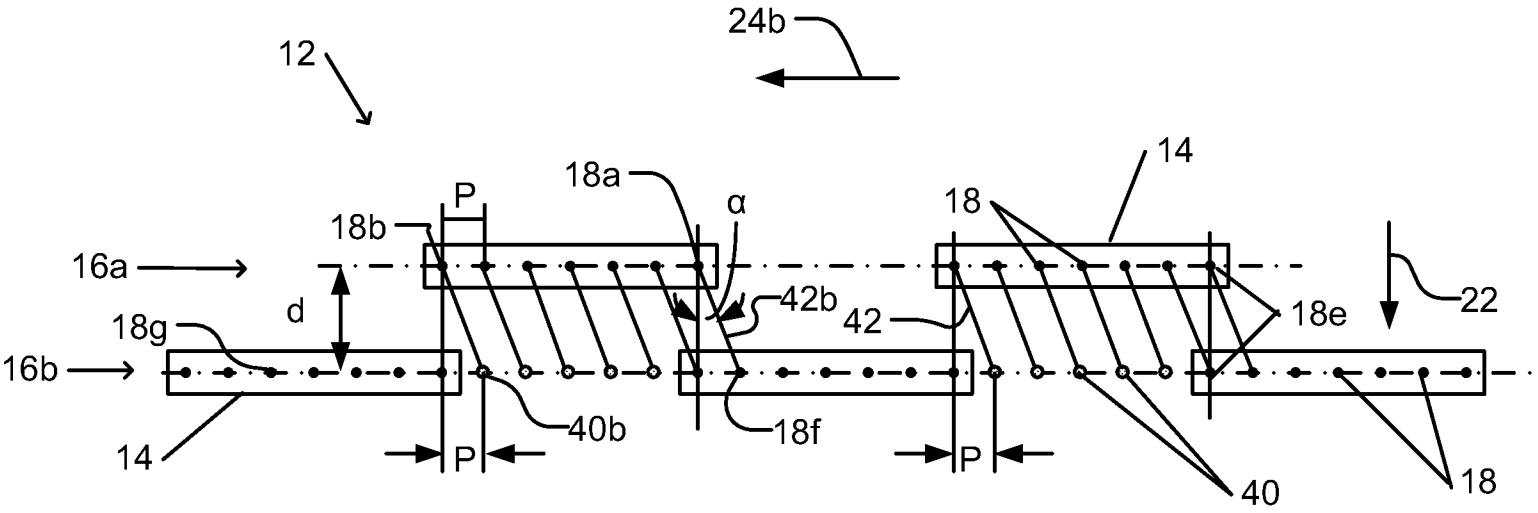
FIG. 5 schematically shows the example of FIG. 4 with the lateral motion reversed.

Examples of coordinated printhead operation may be similar when the direction of the lateral motion is reversed (with the speed of the lateral motion remaining unchanged). FIG. 5 schematically shows the example of FIG. 4 with the lateral motion reversed.

As shown in FIG. 5, lateral motion 24*b* is equal in magnitude to (same speed $v_{lat}$), and opposite in direction to, lateral motion 24*a* of FIG. 4. Due to the lateral symmetry of printhead assembly 12, except for the direction of motion, behavior of printhead assembly 12 remains unchanged from that shown in FIG. 4.

In FIG. 5, nozzle 18*b* in row 16*a* may print a dot 40*b* that is laterally translated during the course of advancing the substrate.

For example, a dot (not shown, for the sake of clarity) that is printed by nozzle 18*a* in row 16*a* may be translated to the position of nozzle 18*f* in row 16*b*. Thus, the paths that are traced by nozzle 18*a* and nozzle 18*f* coincide or overlap in the form of common path 42*b*. In accordance with an example of coordinated printhead operation, nozzle 18*f* may be controlled so as not to deposit ink when opposite the dot that was deposited by the nozzle 18*a*. On the other hand, if nozzle 18*a* had not deposited a dot on the substrate, nozzle 18*f* may be controlled to do so (e.g. if warranted in accordance with a representation of an image to be printed).

Another nozzle 18, such as, for example, nozzle 18*b* of row 16*a* or nozzle 18*g* of row 16*b*, may not share a path with a nozzle in the other of row 16*a* or 16*b*. In accordance with an example of coordinated printhead operation, nozzle 18*b* and nozzle 18*g* may be operated without need to check for previously deposited dots.

The examples of FIGS. 4 and 5 may be contrasted to a printer system that is not configured for coordinated printhead operation as described herein. In such a system, printheads in two rows could be configured to preserve a desired spacing for only one direction of lateral motion of the printhead assembly. Were the direction of lateral motion to be reversed, such a system would either not preserve the desired spacing, or would deposit excessive ink on some locations.

In the examples of FIGS. 4 and 5, nozzles 18 at the ends of printheads 14 in rows 16*a* and 16*b* are made to overlap (e.g. nozzles 18*e*). Thus, each of two nozzles at one end of each printhead 14 in row 16*a* (the end depending on the direction of motion) shares its path with a corresponding nozzle of two nozzles at the opposite end of a printhead in row 16*b*. Other arrangements are possible in which more than two nozzles, or fewer than two nozzles, share a path but preserve a spacing equal to nozzle pitch P between neighboring deposited dots.

Figure 6:
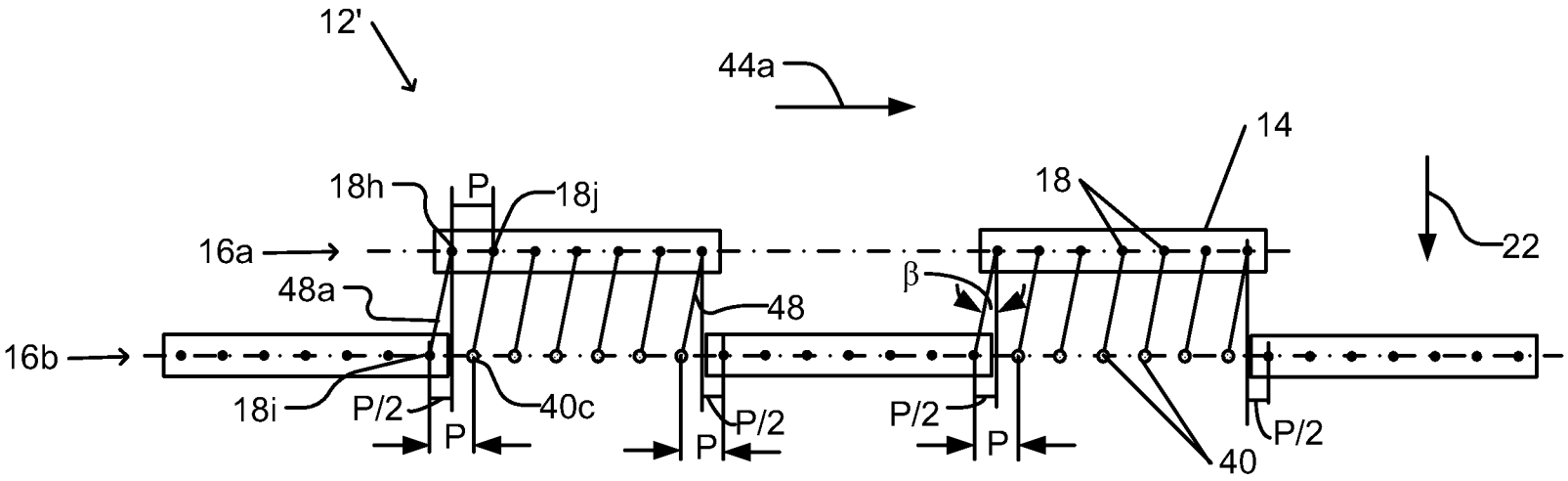
FIG. 6 schematically shows an example of application of coordinated printhead operation for rows of printheads with half-spacing between nozzles in different rows.

FIG. 6 schematically shows an example of application of coordinated printhead operation for rows of printheads with half-spacing between nozzles in different rows. In printhead assembly 12', each nozzle 18 in row 16*a* is laterally displaced by distance equal to one half of nozzle pitch P from the nearest nozzle in row 16*b*. For example, nozzle 18*h* in row 16*a* is laterally displaced from nozzle 18*i* in row 16*b* by a distance of half the nozzle pitch, P/2.

Lateral motion 44*a* may be adjusted with respect to longitudinal motion 22 so that the spacing between neighboring dots that are deposited by nozzles 18 in rows 16*a* and in 16*b* preserve a spacing that is equal to nozzle pitch P. For example, a dot 40*c* may be deposited by nozzle 18*j* in row 16*a*. The speed $v_{lat}$ of lateral motion 44*a* may be adjusted such that when dot 40*c* is moved to opposite row 16*b*, dot 40*c* is moved laterally by a distance of P/2. Thus dot 40*c* is moved such that the distance between dot 40*c* and nearest nozzle 18*i* in row 16*b* is equal to nozzle pitch P. This may be expressed as $$\frac{P}{2} = \frac{d \cdot v_{lat}}{v_{long}}.$$

Each nozzle 18 traces over the substrate a path 48. In this example, each traced path 48 forms an angle β with the direction of longitudinal motion 22, where $$\tan\beta = \frac{v_{lat}}{v_{long}} = \frac{P}{2d}.$$

In this example, nozzle 18*h* in row 16*a* and nozzle 18*i* in row 16*b* trace a common path in the form of common path 48*a*. In accordance with an example of coordinated printhead operation, nozzles 18*h* and 18*i* may be controlled such that only one of nozzles 18*h* and 18*i* deposits ink on each segment of the path.

Figure 7:
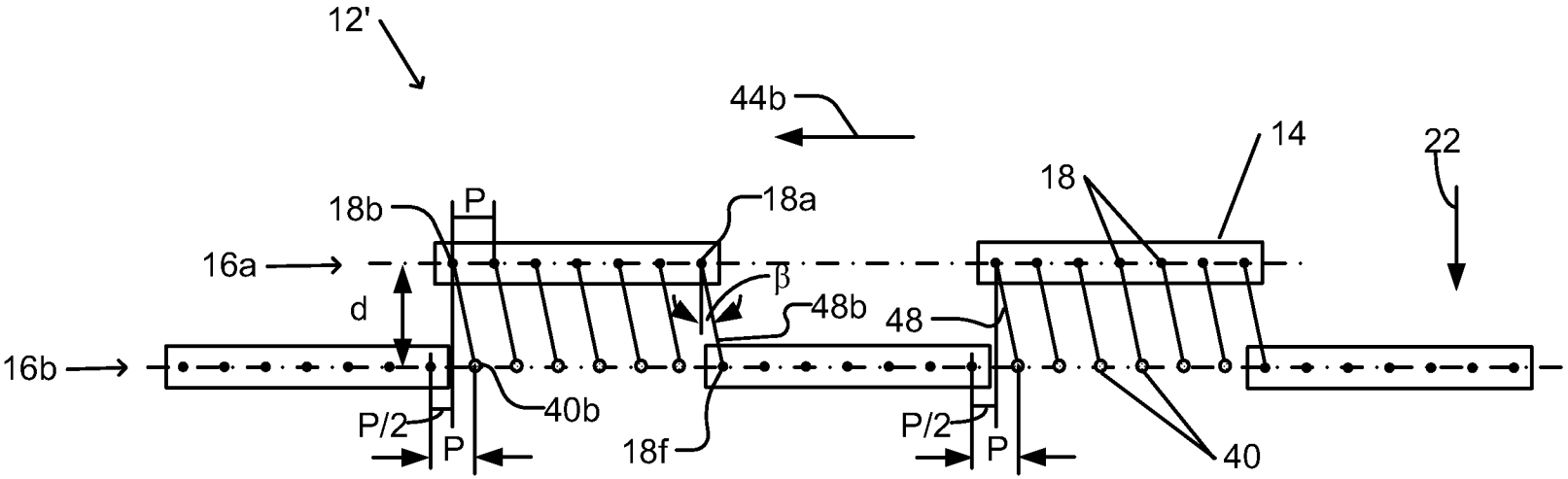
FIG. 7 schematically shows the example of FIG. 6 with the lateral motion reversed.

The direction of the lateral motion may be reversed. FIG. 7 schematically shows the example of FIG. 6 with the lateral motion reversed.

In this case, the spacing equal to nozzle pitch P between neighboring deposited dots is also preserved. For example, nozzle 18*a* in row 16*a* and nozzle 18*f* in row 16*b* trace a common path in the form of common path 48*b*. In accordance with an example of coordinated printhead operation, nozzles 18*a* and 18*f* may be controlled such that only one of nozzles 18*a* and 18*f* deposits ink on each segment of the path.

In addition to the examples that were described above in connection with FIGS. 4-7, other printer systems configured for application of examples of coordinated printhead operation are possible. For example, various combinations of printhead alignment, longitudinal motion, and lateral motion are possible. For example, two or more nozzles at the end of each printhead may overlap a similar number of nozzles of a printhead in another row of a printhead assembly. Thus, depositing of a greater number of nozzles than described above may be controlled in accordance with examples of coordinated printhead operation. Combinations of motions may cause a greater number of traced paths to coincide. Lateral spacing between end nozzles of printheads in different rows may be multiple halves of the nozzle pitch. Additional examples are possible.

I claim:

1. A method comprising:

moving an assembly of printheads with a bidirectional lateral motion, a direction of the lateral motion being substantially perpendicular to, and the lateral motion being concurrent with, a longitudinal motion of a substrate relative to the printhead assembly, nozzles of the printheads being arranged in two rows that are oriented substantially parallel to the direction of the lateral motion, the longitudinal motion and the lateral motion being coordinated such that a nozzle in one of the rows and a nozzle in the other of the rows trace a common path on the substrate.

2. The method of claim 1, further comprising coordinating operation of the nozzles concurrently with the lateral motion and the longitudinal motion such that when the two nozzles that are in different rows trace a common path on the substrate, only one of the two nozzles deposits ink on a segment of the traced common path.

3. The method of claim 1, further comprising reversing the direction of the lateral motion at each of the substrate.

4. The method of claim 1, wherein the longitudinal motion comprises rotation of a drum on which the substrate is mounted.

5. The method of claim 4, wherein the lateral motion remains constant during a plurality of rotations of the drum while the substrate remains mounted on the drum.

6. The method of claim 2, wherein the lateral motion is coordinated with the longitudinal motion such that each of the nozzles is laterally translated by a distance equal to a pitch of the nozzles during longitudinal motion by a distance between two of the rows.

7. The method of claim 2, wherein the lateral motion is coordinated with the longitudinal motion such that each of the nozzles is laterally translated by a distance equal to half of a pitch of the nozzles during longitudinal motion by a distance between two of the rows.

8. A non-transitory computer readable storage medium having stored thereon instructions that when executed by a processor will cause the processor to perform a method to:

move an assembly of printheads with a bidirectional lateral motion that is substantially perpendicular to and concurrent with a longitudinal motion of a substrate relative to the printhead assembly, the nozzles being arranged in a plurality of rows that are oriented substantially parallel to the lateral motion, the lateral motion being coordinated with the longitudinal motion such that a nozzle in one of the rows traces common path over the substrate with a nozzle in another of the rows.

9. The non-transitory computer readable storage medium of claim 8, further comprising instructions to coordinate operation of the nozzles that trace the common path such that only one of the nozzles that trace the common path deposits ink on each segment of the common path.

10. The non-transitory computer readable storage medium of claim 8, wherein the instructions further include instructions to reverse the direction of the lateral motion.

11. The non-transitory computer readable storage medium of claim 10, wherein the instructions to reverse the direction comprise instructions to reverse the direction at each edge of the substrate.

12. The non-transitory computer readable storage medium of claim 8, wherein the longitudinal motion comprises rotation of a drum on which the substrate is mounted.

13. The non-transitory computer readable storage medium of claim 12, wherein the instructions to move the printhead assembly comprise instructions to move the printhead assembly with a constant lateral motion during a plurality of rotations of the drum.

14. The non-transitory computer readable storage medium of claim 8, wherein the coordination of the lateral motion with the longitudinal motion is such that each of the nozzles is laterally translated by a distance equal to a pitch of the nozzles, or to half of the pitch, during longitudinal motion by a distance between two of the plurality of rows.

15. A printer system comprising:

a printhead assembly, nozzles of the printhead assembly being arranged in two substantially parallel rows, the nozzles being configured to deposit ink on a substrate, the printhead assembly configured to move in a bidirectional lateral direction that is substantially perpendicular to a concurrent longitudinal relative motion between the printhead assembly and the substrate and that is substantially parallel to the rows;

a controller for controlling motion of the printhead assembly or depositing of ink by the nozzles on the substrate, a processing unit of the controller being in communication with a computer readable medium, wherein the computer readable medium contains a set of instructions wherein the processing unit is designed to carry out the set of instructions to coordinate the lateral motion with the longitudinal motion such that a nozzle in one of the rows traces common path over the substrate with a nozzle in another of the rows.

16. The system of claim 15, further comprising a drum for holding the substrate such that rotation of the drum results in the longitudinal motion.

17. The system of claim 15, wherein the printhead assembly is mounted on a bridge, and wherein the lateral motion comprises motion of the printhead assembly along a length of the bridge.

18. The system of claim 15, wherein one of the nozzles in one of the rows is located at a lateral position that is substantially equal to a lateral position of another of the nozzles in the other row.

19. The system of claim 15, wherein a lateral distance one of the nozzles in one of the rows and another of the nozzles in the other row is substantially equal to one half of the pitch between adjacent nozzles on a single printhead of the printhead assembly.

20. The system of claim 15, wherein the processing unit is further designed to carry out the set of instructions to coordinate operation of the nozzles that trace the common path, such that only one of the two nozzles deposits ink on the substrate in a segment of the traced common path.

* * * * *